US005897259A

United States Patent [19]

Ahn

[11] Patent Number: 5,897,259

[45] Date of Patent: Apr. 27, 1999

[54] PAPER FEEDING UNIT FOR APPARATUS USING PRINTER HEAD

[75] Inventor: Byung-Sun Ahn, Suwon, Rep. of Korea

[73] Assignee: SamSung Electronics Co., Ltd., Suwon, Rep. of Korea

[21] Appl. No.: 08/922,306

[22] Filed: Sep. 2, 1997

[30] Foreign Application Priority Data

Aug. 30, 1996 [KR] Rep. of Korea ..... 96-37155

[51] Int. Cl.[6] ..... B41J 11/58

[52] U.S. Cl. ..... 400/629; 271/109; 347/104

[58] Field of Search ..... 400/629, 634, 400/636, 636.3, 637, 641, 642, 645, 645.3, 645.4; 347/104; 271/109, 113, 226

[56] References Cited

U.S. PATENT DOCUMENTS

| | | | |
|---|---|---|---|
| 5,118,208 | 6/1992 | Kitahara | 400/642 |
| 5,261,754 | 11/1993 | Sugiura | 400/636.3 |
| 5,291,224 | 3/1994 | Asano et al. | 400/641 |
| 5,420,621 | 5/1995 | Richtsmeier et al. . | |
| 5,527,123 | 6/1996 | Jackson et al. . | |
| 5,564,847 | 10/1996 | Patrick et al. . | |
| 5,580,042 | 12/1996 | Taniguro et al. | 400/636.3 |
| 5,594,486 | 1/1997 | Kiyohara | 400/636 |
| 5,673,074 | 9/1997 | Miyauchi et al. | 400/645 |
| 5,681,124 | 10/1997 | Yasuoka | 400/636.3 |

FOREIGN PATENT DOCUMENTS

| | | | |
|---|---|---|---|
| 40-3112693 | 5/1991 | Japan | 400/636.3 |

OTHER PUBLICATIONS

"Document Feed Device" IBM Tech–Disclosure Bulletin, vol. 32 No. 8A; Jan. 1990 pp. 244–245, Jan. 1990.

*Primary Examiner*—Eugene H. Eickholt
*Attorney, Agent, or Firm*—Robert E. Bushnell, Esq.

[57] ABSTRACT

A paper feeding unit for a printing apparatus including conveyance and friction rollers conveying paper from a paper cassette to an image-transfer zone, the paper being urged against a frame, having a surface substantially parallel with the image-transferring zone, with one end of a spring mounted on the end of a cantilevered paper guide.

16 Claims, 9 Drawing Sheets

PAPER FEEDING UNIT FOR APPARATUS USING PRINTER HEAD

CLAIM OF PRIORITY

This application makes reference to, incorporates the same herein, and claims all benefits accruing under 35 U.S.C. §119 from an application entitled Paper feeding Unit for Apparatus Using Ink-jet Printer Head earlier filed in the Korean Industrial Property Office on Aug. 30, 1996, and there duly assigned Ser. No. 96-37155 by that Office.

BACKGROUND OF THE INVENTION

1. Field of the Invention

The present invention relates to printers. More particularly, the present invention relates to a paper feeding unit in a printer that reduces curling of the recording stock and maintains a gap between the printer head and the print media.

2. Discussion of Prior Art

Ink-jet printers, facsimiles, copy machines and like apparatuses employ printer heads. Referring to FIGS. 7–10, many printers include a head cartridge 1 containing ink used to form characters on print media, a carriage 2 that moves the head cartridge 1 along the print area, and a driving unit (not illustrated). The printer also includes a paper cassette 3 holding paper P, pickup rollers 4 for picking up paper, a paper sensor (not illustrated), conveyance rollers 5, aligning the leading edge of the paper and conveying it, and a registration sensor 6 controlling the conveyance rollers 5 and aligning the leading edge of the paper. A guide 7 conveys the paper, and a paper delivery roller 8 discharges the paper.

Once a print command is received by the printer from a host computer, the control unit of the printer directs the drive unit to operate. The pickup rollers 4 pick up the paper P one sheet at a time from the paper cassette 3 and deliver the sheets to the conveyance rollers 5 along the guide 7.

The registration sensor 6 converts a distance to the entrance to the conveyance rollers into time, and adds paper to be conveyed according to a value obtained by the conversion to let the paper be curled between the pickup rollers 4 and the conveyance rollers 5, aligning its leading edge. The conveyance rollers 5 deliver the paper to the printer front zone below a nozzle 1*a* of the cartridge 1. The cartridge 1 on the carriage 2 is translated according to a signal produced from a head driver, depositing ink particles on the paper to form characters thereon. Once the one-line printing is completed, the conveyance rollers 5 transfer the paper by a given length to complete the overall printing job, and the paper is output through the paper delivery roller 8, thus finishing one-cycle printing.

In the conventional ink-jet printer several problems may occur frequently when the paper P, picked up by the pickup rollers 4, is conveyed to a printing zone S. Referring to FIG. 9, a conveyance zone y exists between line k and the printing zone S. The paper, transferred by the conveyance force of the conveyance rollers 5, passes through the conveyance zone y into the printing zone S where characters are formed on the paper P by the cartridge 1. The characteristics of the paper P vary with the humidity and temperature of the room in which the printer is situated. The paper P must be used in a room with proper humidity and temperature to ensure good print quality. Improper temperature and humidity causes a paper curling problem in the conveyance zone y. The result of the paper curling problem is particularly acute after the paper moves into the printing zone y. In a room having improper temperature and humidity, the paper curls toward the printer or image-transferring head, which causes distorted images, smearing and other problems. Conventional printers typically do not have any mechanisms for preventing the paper curling problem. Therefore, printing sometimes is carried out on the paper having a portion elevated beyond a printing interval formed between the nozzle 1*a* of the cartridge 1 and a guide frame 11. During printing, some areas of the paper P gets close to the nozzle 1*a* of the cartridge 1, the interval between the paper P and the nozzle 1*a* being not constantly maintained, thus making the print quality inferior. In the worst case, the curled paper directly contacts the nozzle 1*a* of the cartridge 1 to make the nozzle 1*a* of the cartridge 1 unclean and deteriorating the overall print quality. In addition, the nozzle 1*a* of the cartridge 1 must be cleaned frequently. The paper curling problem also makes it difficult to introduce the leading edge of the paper between the paper delivery rollers 8, thus resulting in a paper jam.

The above demonstrates a need for a mechanism that reduces the potential image transfer and paper feed problems associated with paper curl.

U.S. Pat. No. 5,564,847 for Media Handling in an Ink-jet Printer Having Guide Ribs issued to Patrick et al., and also U.S. Pat. No. 5,527,123 for Media Handling in an Ink-jet Printer issued to Jackson et al., include an upper print media guide 118 having an extending portion 119 that terminates in a lower support edge 122 which contacts and supports paper 110 from above. A lower print media guide 126, downstream from the upper medium guide, includes an upwardly extending support edge 130. Although the medium 110 is shown maintaining a uniform spacing between it and a printer head 103, between the two dashed lines of FIG. 3, the lower support edge 122 and the upper support edge 130 actually urge the medium 110 to assume a humped, or non uniform, print area relative to the head 103.

U.S. Pat. No. 5,420,621 for Double Star Wheel for Post-printing Media Control in Inkjet Printing issued to Richtsmeier et al., referring to FIG. 1, includes a main drive roller 15 with idler roller 16 cooperating to maintain tension in the sheet 12. The device also includes a starwheel-type pinch wheel 28 which cooperates with an output driver roller 26 to maintain tension in the sheet and to control the position of the sheet relative to the printer head 22.

SUMMARY OF THE INVENTION

The present invention is a paper feeding unit for an apparatus using an ink-jet printer head which includes a mechanism for maintaining paper so that it does not raise or curl toward the printer head or away from discharge rollers. The invention includes a plurality of springs installed on the friction rollers in close contact with the conveyance rollers. The springs, axially diverged, have ends which press the paper against the frame, proximate to the printing area, urging the paper to remain against the frame in an uncurled sate.

Accordingly, it is an object of the present invention to provide a paper feeding unit which prevents paper curling problems without modifying a conventional paper feeding mechanism.

Additional features and advantages of the invention will be set forth in the description which follows, and in part will be apparent from the description, or may be learned through practice of the invention.

BRIEF DESCRIPTION OF THE ATTACHED DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

Figure 5:
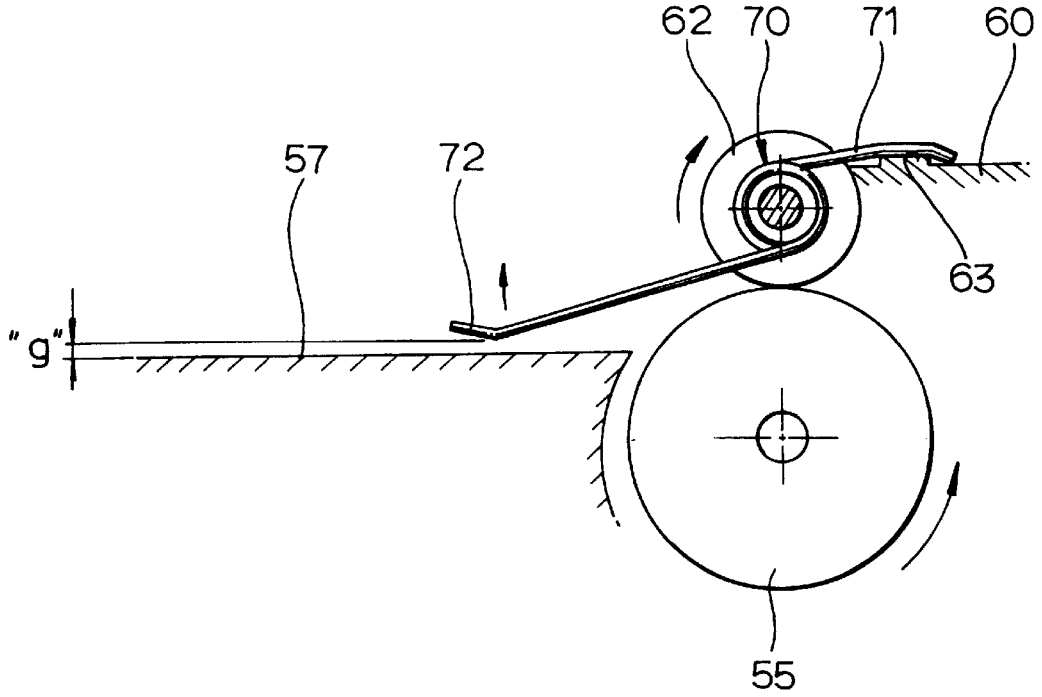
Figure 6:
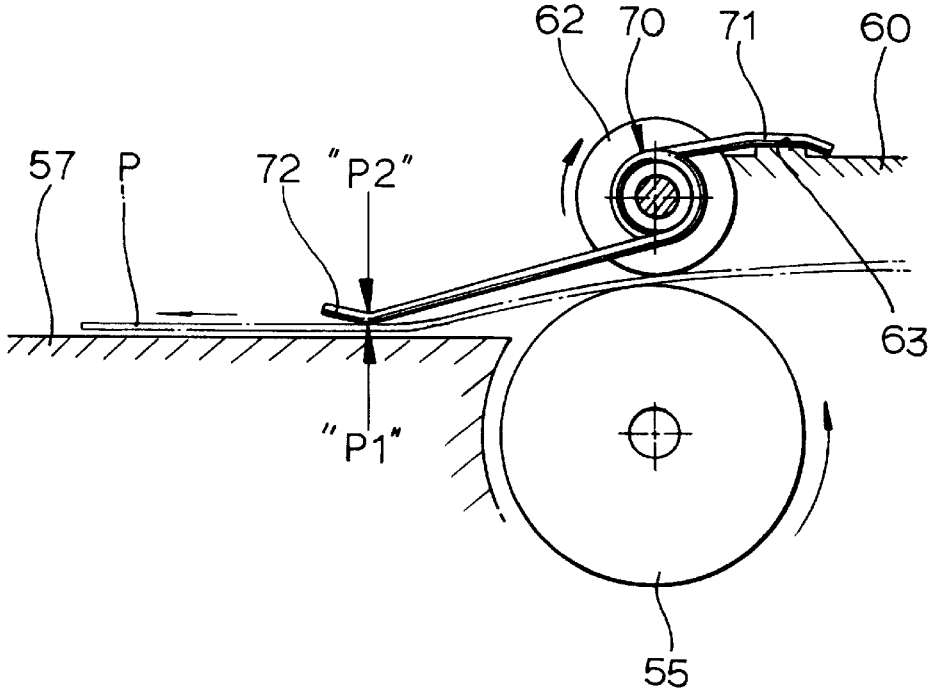
Figure 7:
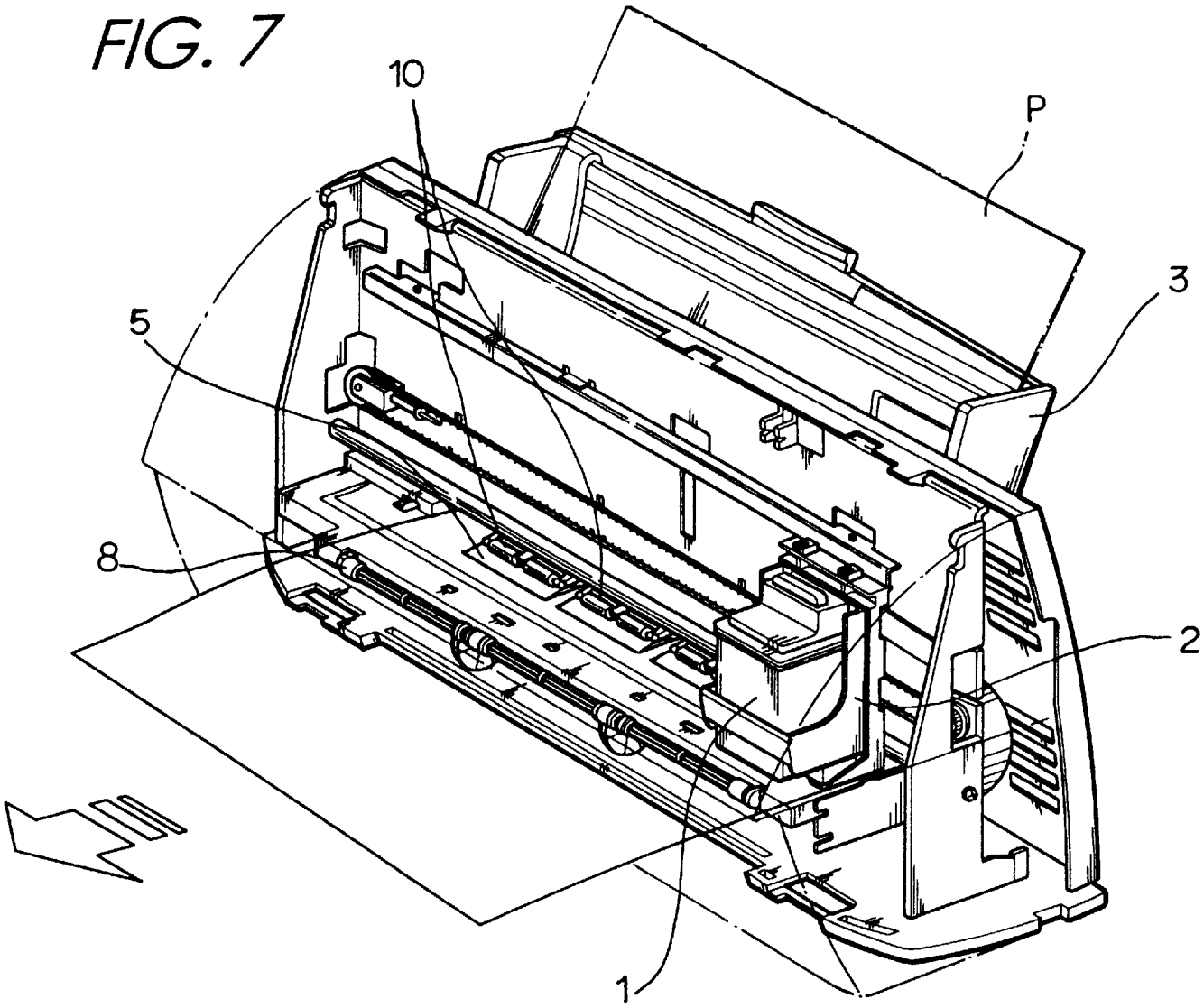
Figure 8:
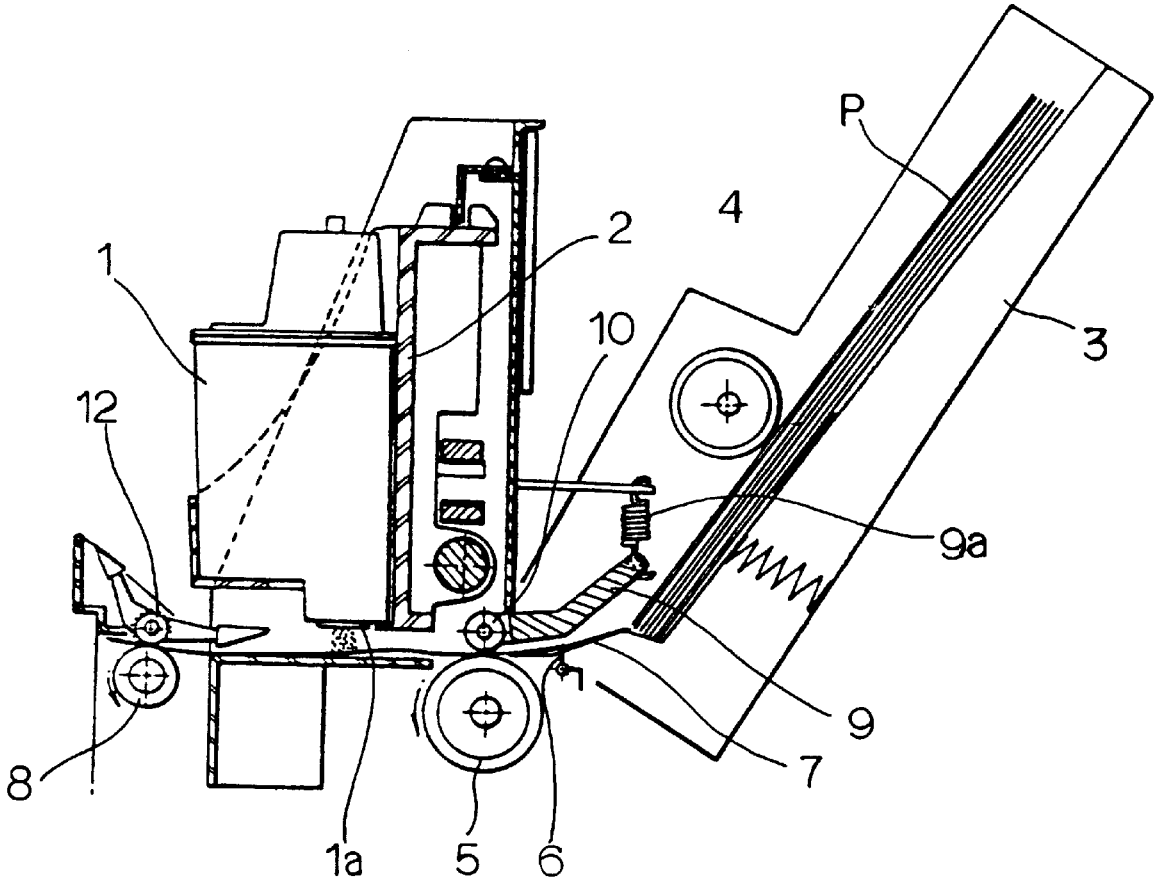
Figure 9:
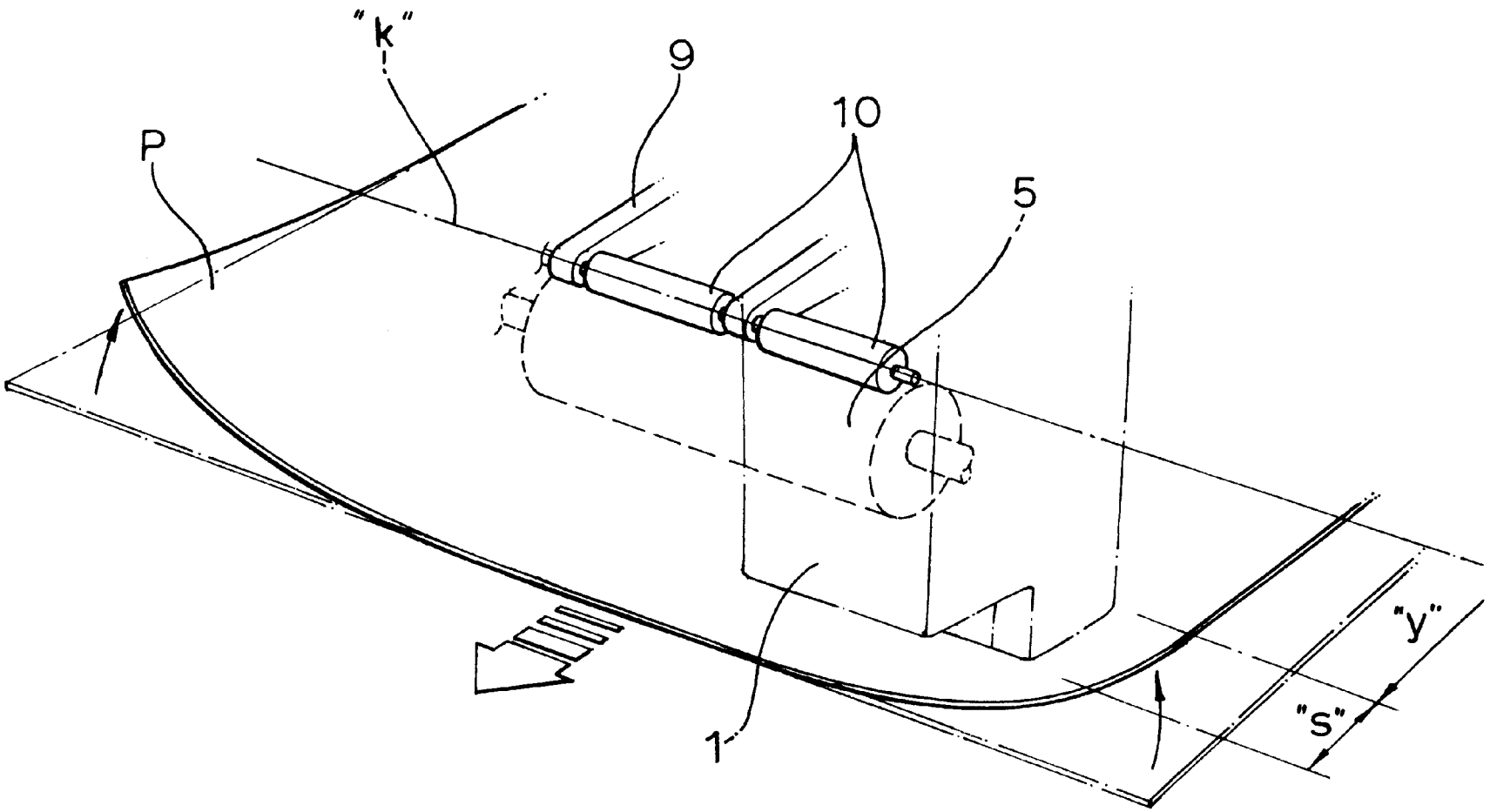
Figure 10:
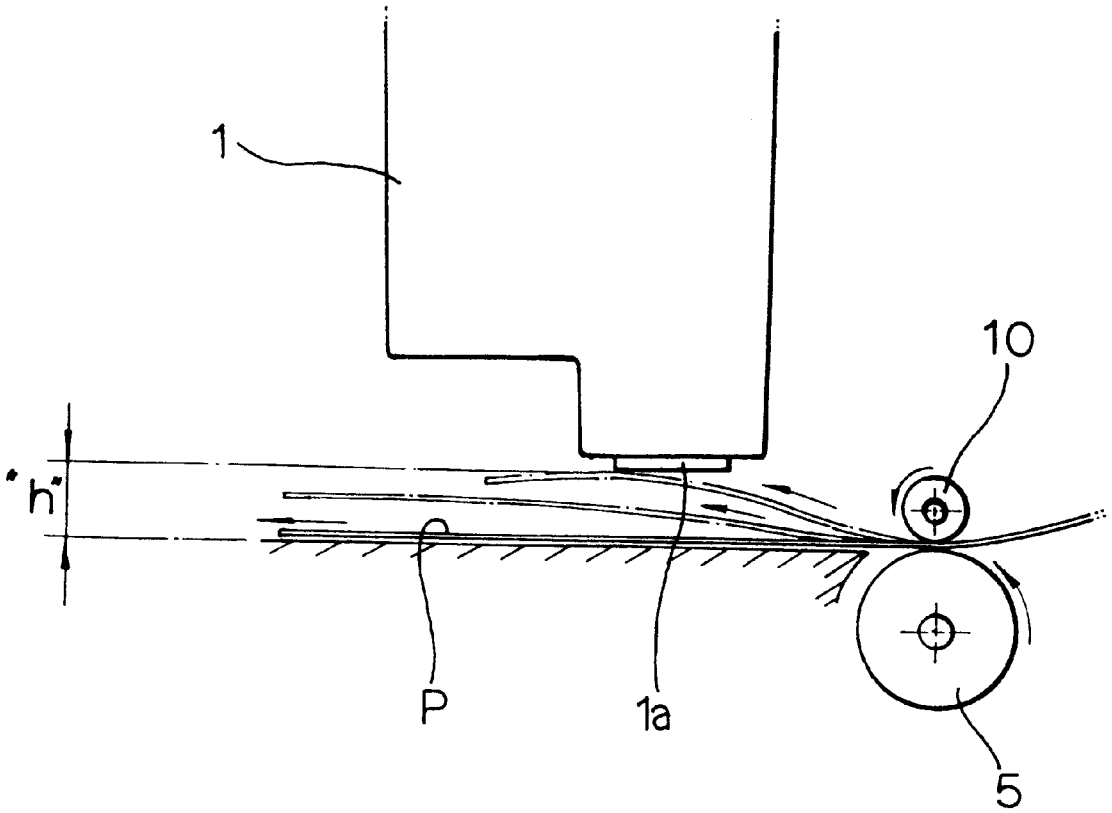

FIGS. 5 and 6 each are vertical schematic representations of the present invention installed in a paper feed mechanism;

FIG. 7 is a top right front perspective view of the interior of a conventional printer;

FIG. 8 is a vertical cross sectional detail view of a paper feeding unit;

FIG. 9 is a partial top right front perspective view of a typical paper feeding mechanism; and FIG. 10 is a vertical schematic representation of a typical paper feeding mechanism.

DETAILED DESCRIPTION OF PREFERRED EMBODIMENT

Figure 1:
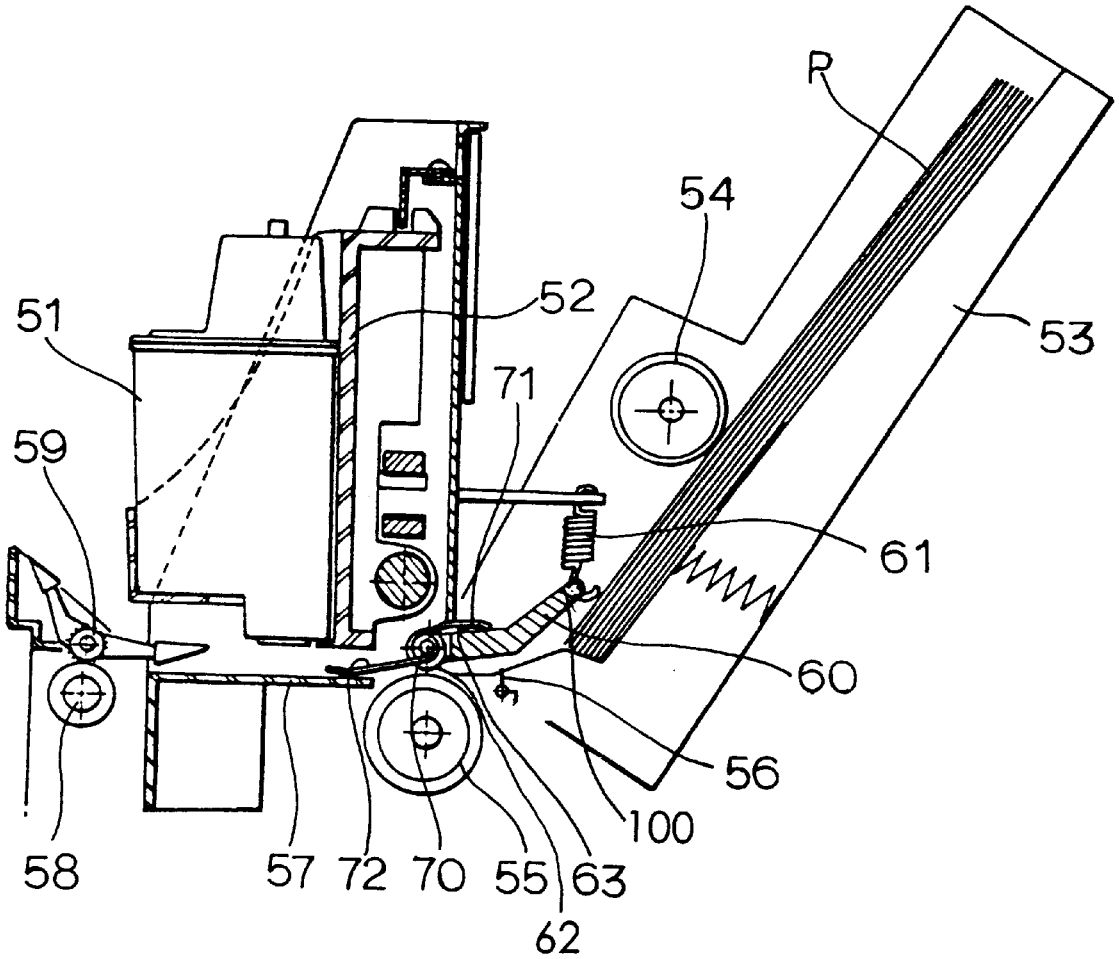
FIG. 1 is a vertical cross sectional detail view of the present invention installed in a paper feed mechanism.

Referring to FIG. 1, paper P of a paper cassette 53 is delivered to conveyance rollers 55 by pickup rollers 54. A registration sensor 56, installed at the front end of the conveyance rollers 55, is activated by the paper P. The conveyance rollers 55, responsive to the registration sensor 56, rotate in a reverse direction to align the leading edge of the paper P. Once the leading edge of the paper is aligned by the conveyance rollers 55, the pickup rollers 54 stop and the conveyance rollers 55 rotate forwardly to deliver paper to a conveyance zone between the cartridge 51 and the conveyance rollers 55.

Figure 2:
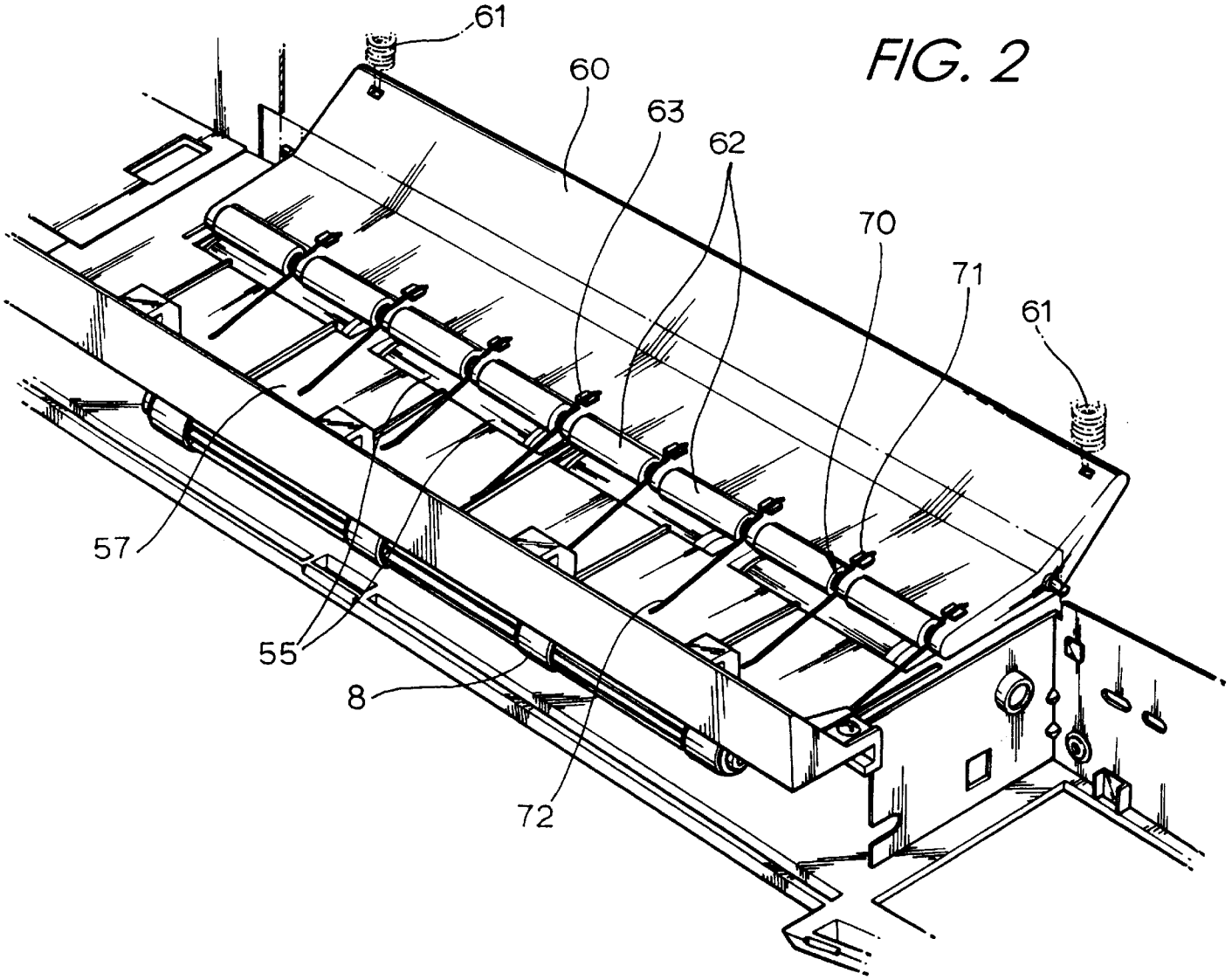
FIG. 2 is a top right front perspective view of the present invention installed in a paper feed mechanism.

Referring also to FIG. 2, a paper guide 60 is mounted over the conveyance rollers 55 and drawn away from the paper with a spring 61. Friction rollers 62 on the front end of the paper guide 60 contact the top of the conveyance rollers 55, rotating in synchronicity with the conveyance rollers 55.

Figure 3:
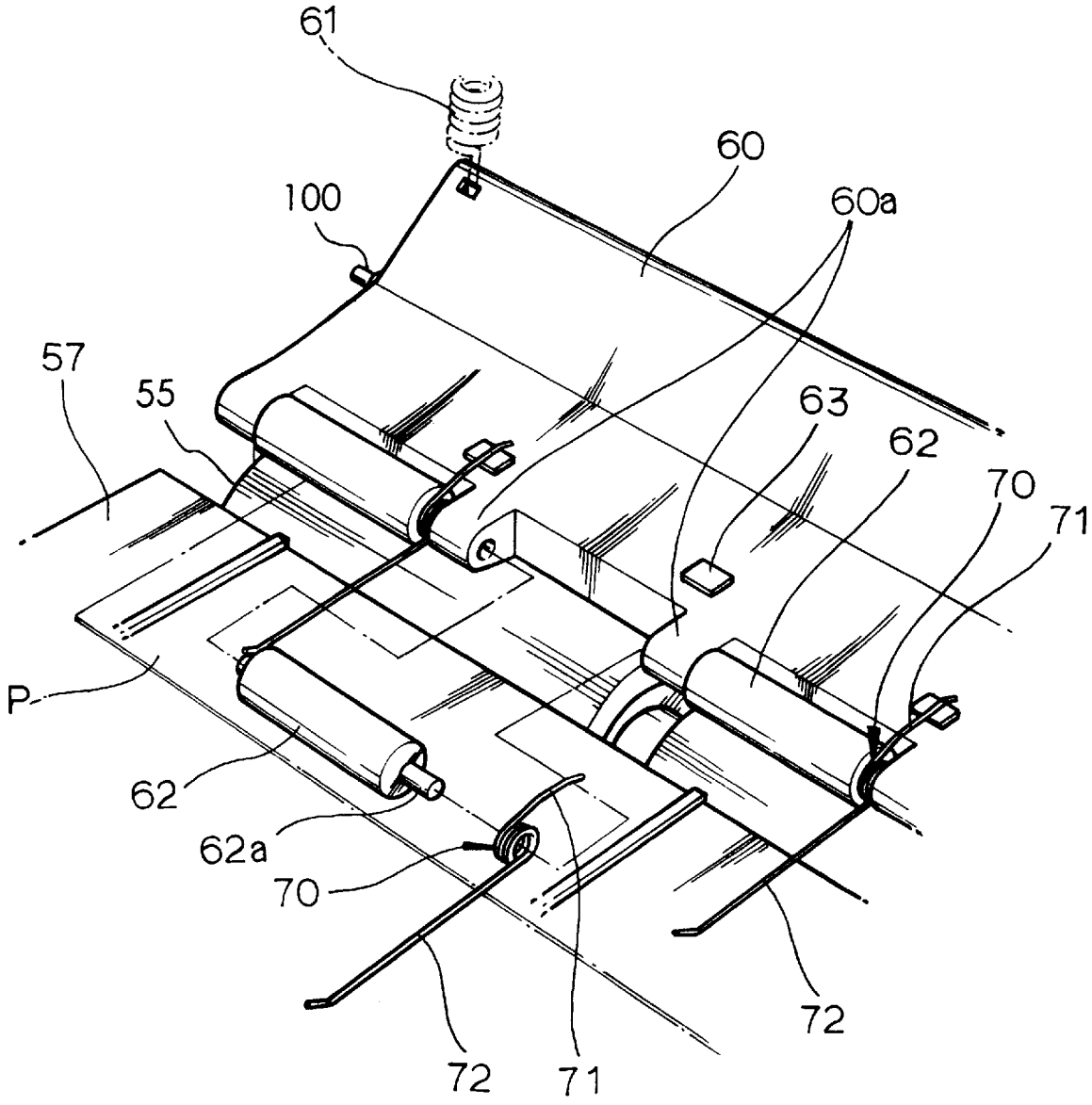
FIG. 3 is an enlarged partial right front exploded perspective view of the present invention installed in a paper feed mechanism.

Referring also to FIG. 3, each of the friction rollers 62 includes roller shafts 62*a*. held by shaft bosses 61*a*. Coil springs 70 include a support end portion 71 contacting stopper 63 on the paper guide 60, and a tension guide 72 that discourages the paper P from being raised.

A plurality of springs 70 each are mounted on the roller shafts 62*a*, spaced at given distances from each other. Each of the friction rollers 62 are urged against the conveyance roller 55 by the spring 61 cantilevering the paper guide 60 about pin 100. The tension guides 72 of the springs 70 may be configured to closely contact the guide frame 57.

In operation, once the electric motor goes into action, responsive to a command to print from a host computer, the pickup rollers 54 pick up the paper P from the paper cassette 53, one by one, and route each sheet to the conveyance rollers 55. When the paper P activates the registration sensor 56 at a predetermined point near the front end of the conveyance rollers 55, the registration sensor 56 converts a distance from the registration sensor 56 to the entrance to the conveyance rollers 55 (where the conveyance rollers 55 contact the friction rollers 62) and a distance forming a loop in a space between the paper guide 60 for alignment of the leading edge of the paper into the time.

The leading edge of the paper P moves into the point where the conveyance rollers 55 contact the friction rollers 62, triggering the registration sensor 56. The conveyance rollers 55 reverse rotation while the pickup rollers 54 are brought to a standstill, and the leading edge of the paper P is pushed toward the paper cassette 53. The rear end of the paper P is caught by the pickup rollers 54, and the middle part of the paper is bent upward within a space beneath the paper guide 60, thus forming a temporary loop. When the middle part of the paper is spread out again, the aligned leading edge of the paper P contacts the conveyance rollers 55 and friction rollers 62.

Figure 4:
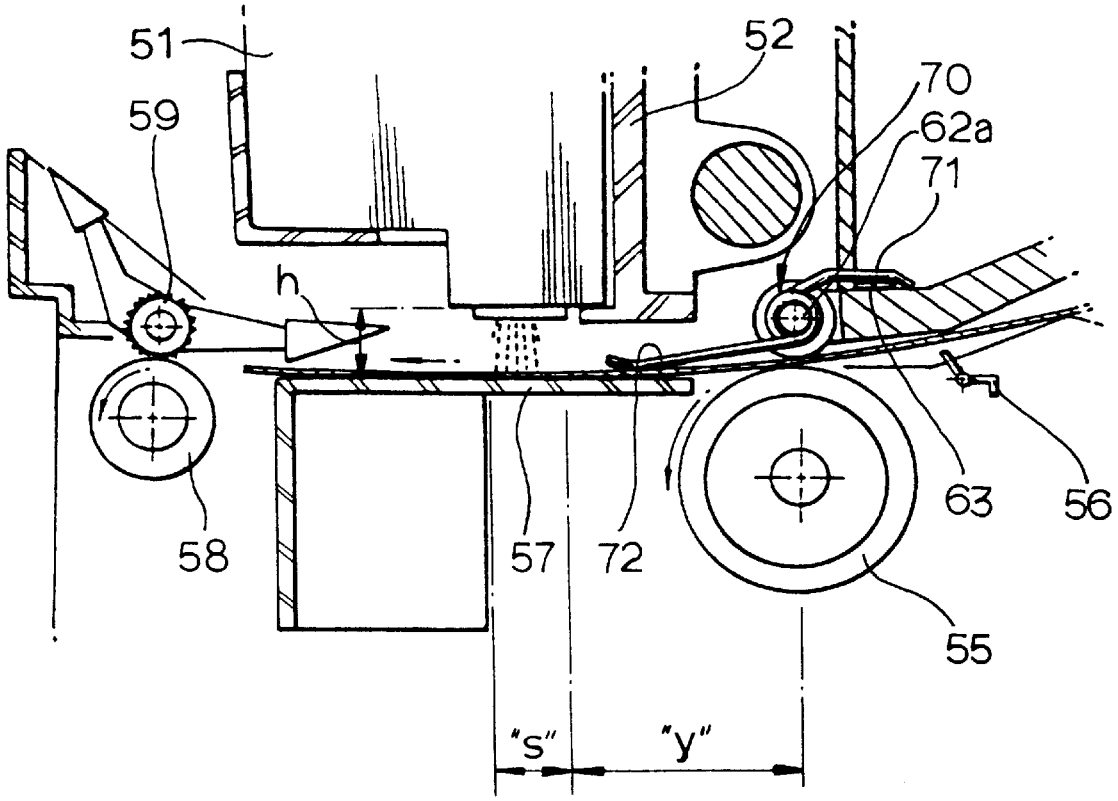
FIG. 4 is a partial vertical cross sectional detail view of the present invention installed in a paper feed mechanism.

Referring to FIG. 4, as soon as the paper alignment process is completed, the conveyance rollers 55 begin to rotate forwardly and, simultaneously, the pickup rollers 54 also rotate forwardly, advancing the paper into the conveyance zone y. The pickup rollers 54 stop rotating as soon as the paper completely passes through the pickup rollers 54, and the conveyance rollers 55 advance the paper P into the conveyance zone y.

Referring now to FIGS. 4–6, the paper P is conveyed as the conveyance rollers 55 rotate counterclockwise, and the friction rollers 62 rotate clockwise. The rotating force of the friction rollers 62 is transmitted to the torsion spring 70 so that a gap "g" is created between the tension guide 72 and the frame 57.

The size of the gap "g" depends on the thickness of paper P used. If the thickness of the paper is larger than the gap "g," or the strength of the spring is so large that the paper P is bent, a force P1 for moving the tension guide 72 of the spring 70 upward, is generated. A repelling force P2 is created by the torsion spring 70, compressing the paper P into the given scope of the gap "g" prior to entering the printing zone S. This configuration assures a constant printing interval h. This configuration predisposes the paper to remain substantially flat, and eventually reliably fed between the delivery roll 58 and friction wheel 59, precluding paper jams.

As described above, the inventive means of keeping paper from being raised, prevents paper curling, image blurring or paper jam problems throughout the cycle of paper through a printer. The front end of the tension guide 72 of the torsion spring 70 does not interfere with the printing zone S.

According to the present invention, the printer head is designed to be spaced a given distance away from the print media, to assure unblurred images. The present invention precludes image blurring and paper jam problems, as well as the difficulties associated with introducing paper into paper delivery rollers often caused by interference of light or bent print media with the printer head. In addition, the slim tension guides of the present coil springs keep the paper from being raised, enhancing the space utilization of the apparatus.

It will be apparent to those skilled in the art that various modifications and variations may be made in the inventive paper feeding unit without departing from the spirit or scope of the invention as claimed.

What is claimed is:

1. An apparatus for reducing curl of a recording medium, comprising:

a frame providing a path of conveyance for a printable recording medium during formation of images on the medium;

a paper guide pivotally mounted on said frame with a leading end of said paper guide defining an orifice accommodating entry of a leading edge of the medium as the medium travels along said path, said paper guide rotating by an amount accommodating passage of media guided along said path;

a conveyance roller positioned along said path;

a second roller mounted on a trailing end of said guide to form a nip with said conveyance roller;

a spring mounted on said guide in coaxial rotational engagement with one end of said second roller, said spring having a first end extending radially outwardly from said one end to engage said frame within said path, and a second end engaging said guide while said first end engages said frame;

said rotational engagement forcing a separation between said first end and the frame defining a gap that receives the leading edge during rotation of said second roller; and said first end restraining displacement of the medium from said frame prior to said formation of images.

2. The apparatus as recited in claim 1, further comprising a resilient member biasing a second end of said paper guide to maintain said first end of said spring with said frame.

3. The apparatus as recited in claim 1, further comprising a resilient member biasing said second roller to maintain engagement with said conveyance roller along said nip.

4. The apparatus as recited in claim 1, further comprised of said spring having a coiled section intermediate said first end and said second end, said coiled section biasing said first end of said spring toward said frame.

5. An apparatus for reducing curl of a recording medium, comprising:

a frame providing a path of conveyance for a printable medium during formation of images on the medium;

a guide pivotally mounted on said frame with a leading end positioned along said path to form an orifice accommodating entry of a leading edge of the medium;

a conveyance roller positioned along said path in an operational relation with a trailing end of said guide;

an elongate member disposed on said trailing end of said guide in a rotationally responsive relation to said conveyance roller, said elongate member having a first end extending longitudinally outwardly from said trailing end into said path to engage said frame, and a second end biased against said rotationally responsive relation to urge engagement of said first end against said guide;

said elongate member responding to rotation of said conveyance roller while in said rotationally responsive relation by rotating away from said frame and against said urge while controlling a distance of separation between the medium travelling along said path and an image-transferring head oriented to form said images upon the medium within an image-transferring zone of said path while restraining movement of the medium away from said frame within said image-transferring zone.

6. The apparatus as recited in claim 5, further comprised of a spring biasing said guide relative to the image-transferring head.

7. The apparatus as recited in claim 5, further comprised of a second roller being mounted on said trailing end of said guide to form a nip with said conveyance roller.

8. The apparatus as recited in claim 5, further comprised of:

a roller rotatable mounted on said guide in rotational engagement with said elongate member; and a spring biasing said guide relative to the image-transferring head.

9. The apparatus as recited in claim 6, further comprised of a roller frictionally engaging said conveyance roller while maintaining rotational engagement with said elongate member.

10. The apparatus as recited in claim 9, further comprised of a spring biasing said guide relative to the image-transferring head.

11. A paper feeding unit for an apparatus using an ink-jet printer head, comprising:

conveyance rollers furnishing a conveyance force to paper held in a paper cassette;

friction rollers installed over each of the conveyance rollers, corresponding to it for giving a pressure force to the paper, thus making the paper be conveyed;

a paper guide having the friction rollers rotatably installed, and its rear end receiving an elasticity from tension springs so as to make the friction rollers come in close contact with the conveyance rollers; and means of keeping the paper from being raised, provided to roller shafts of the respective friction rollers, and pressing the paper, conveyed by the conveyance rollers and the friction rollers, not to be raised.

12. A paper feeding unit according to claim 11, wherein said means are torsion coil springs each provided to the roller shafts of the friction rollers for moving the paper, corresponding to the conveyance rollers.

13. A paper feeding unit according to claim 12, wherein each of the torsion coil springs includes a support end portion, held by the paper guide, and a tension guide formed opposite to the support end portion for keeping the paper from being raised.

14. A paper feeding unit according to claim 13, wherein a gap, a space used for paper conveyance, is created between the tension guide and a base frame through which the paper passes during the paper conveyance of the conveyance rollers and friction rollers.

15. A paper unit according to claim 13, wherein the front end of the tension guide of the torsion coil spring does not exceed the printing zone.

16. A paper feeding unit for an apparatus using ink-jet printer head, comprising:

conveyance rollers for furnishing a conveyance force to paper held in a paper cassette;

friction rollers installed over each of the conveyance rollers, corresponding to it for giving a pressure force to the paper, thus making the paper be conveyed;

a paper guide having the friction rollers rotatably installed, and its rear end receiving an elasticity from tension springs so as to make the friction rollers come in close contact with the conveyance rollers; and torsion coil springs with a tension guide and a paper guide, provided to roller shafts of the respective friction rollers, and pressing the paper, conveyed by the conveyance rollers and the friction rollers, not to be raised.

* * * * *